US009831604B2

(12) United States Patent
Giefers

(10) Patent No.: US 9,831,604 B2
(45) Date of Patent: Nov. 28, 2017

(54) PLUG CONNECTOR SYSTEM

(71) Applicant: Phoenix Contact GmbH & Co. KG, Blomberg (DE)

(72) Inventor: Stefan Giefers, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/310,450

(22) PCT Filed: May 19, 2015

(86) PCT No.: PCT/EP2015/061010
§ 371 (c)(1),
(2) Date: Nov. 11, 2016

(87) PCT Pub. No.: WO2015/177159
PCT Pub. Date: Nov. 26, 2015

(65) Prior Publication Data

US 2017/0093089 A1 Mar. 30, 2017

(30) Foreign Application Priority Data

May 19, 2014 (DE) ..... 10 2014 107 029

(51) Int. Cl.
*H01R 13/627* (2006.01)
*H01R 13/639* (2006.01)

(52) U.S. Cl.
CPC ..... *H01R 13/639* (2013.01)

(58) Field of Classification Search
CPC ..... H01R 13/6271; H01R 13/6272; H01R 13/6275
(Continued)

(56) References Cited

U.S. PATENT DOCUMENTS 6,340,310 B2 * 1/2002 Henrici ..... H01R 33/0836 439/346
7,661,977 B2 * 2/2010 Zayas ..... H01R 13/6275 439/357
(Continued)

FOREIGN PATENT DOCUMENTS

DE 20201609 U1 6/2003
DE 102006054647 A1 5/2008
(Continued)

*Primary Examiner* — Abdullah Riyami
*Assistant Examiner* — Thang Nguyen
(74) *Attorney, Agent, or Firm* — Leydig, Voit & Mayer, Ltd.

(57) ABSTRACT

A plug-in connector system includes a multi-point connector, an electrical plug connector that can be attached to the multi-point connector, and a locking element for locking the electrical plug connector to the multi-point connector. The multi-point connector includes a plug portion and the plug connector includes a receiving portion that has a receiving opening such that, for connecting the plug connector to the multi-point connector, the plug portion can be guided through the receiving opening so as to engage in the receiving portion. A lock receiving opening is arranged in a side wall of the receiving portion at a spacing from the receiving opening. The side wall includes a first side wall portion between the receiving opening and the lock receiving opening and a second side wall portion between the lock receiving opening and the receiving base of the receiving portion.

10 Claims, 5 Drawing Sheets

(58) Field of Classification Search
USPC ..... 439/357, 352
See application file for complete search history.

(56) References Cited

U.S. PATENT DOCUMENTS

| | | | | |
|---|---|---|---|---|
| 2008/0119090 | A1 | 5/2008 | Giefers | |
| 2010/0267271 | A1* | 10/2010 | Amidon | H01R 13/6275 439/357 |
| 2011/0008983 | A1 | 1/2011 | Sprenger et al. | |
| 2011/0195591 | A1* | 8/2011 | Mumper | H01R 13/6272 439/345 |
| 2015/0222055 | A1* | 8/2015 | Plazio | H01R 13/641 439/347 |
| 2016/0072226 | A1* | 3/2016 | Puhl | H01R 13/6273 439/352 |

FOREIGN PATENT DOCUMENTS

| | | | |
|---|---|---|---|
| DE | 102010017262 | A1 | 12/2011 |
| EP | 2273626 | A1 | 1/2011 |
| WO | 2014060229 | A1 | 4/2014 |

* cited by examiner

PLUG CONNECTOR SYSTEM

CROSS-REFERENCE TO PRIOR APPLICATIONS

This application is a U.S. National Phase application under 35 U.S.C. §371 of International Application No. PCT/EP2015/061010, filed on May 19, 2015, and claims benefit to German Patent Application No. DE 10 2014 107 029.1, filed on May 19, 2014. The International Application was published in German on Nov. 26, 2015 as WO 2015/177159 A1 under PCT Article 21(2).

FIELD

The invention relates to a plug-in connector system, in particular a plug-in connector system comprising a multi-point connector, an electrical plug connector that can be attached to the multi-point connector, and a locking element for locking the electrical plug connector to the multi-point connector.

BACKGROUND

In the technological field of connecting electrical plug connectors, plug-in connector systems are known in principle from practice. DE 10 2006 054 647 A1 discloses, for example, an electrical plug connector coupling in which a plug connector coupling comprises two plug housings that can be coupled to one another. The two plug housings are interlocked by means of a latch connection. For this purpose, latching lugs are formed on the first plug housing and corresponding latching tongues are formed on the second plug housing. To unplug the first plug housing from the second plug housing, the latching tongue must be pivoted out of the second plug housing in a direction perpendicular to the unplugging direction of the first plug housing. The unplugging process is therefore laborious.

Another plug-in connector system is known from DE 10 2010017 262 A1. Here, the connector plug attached to the main housing is locked by means of a locking device that can be attached from above to the main housing and the connector plug. A disadvantage of this system is the large overall height produced by the attachable locking device.

SUMMARY

In an embodiment, the present invention provides a plug-in connector system comprising: a multi-point connector; an electrical plug connector configured to be attached to the multi-point connector; and a locking element configured to lock the electrical plug connector to the multi-point connector. The multi-point connector comprises a plug portion and the plug connector comprises a receiving portion that has a receiving opening such that, for connecting the plug connector to the multi-point connector, the plug portion is configured to be guided through the receiving opening so as to engage in the receiving portion. A lock receiving opening is arranged in a side wall of the receiving portion at a spacing from the receiving opening. The side wall comprises a first side wall portion between the receiving opening and the lock receiving opening and a second side wall portion between the lock receiving opening and the receiving base of the receiving portion. The locking element comprises a control element and a lock portion that has a lock upper face and a lock lower face, wherein the lock portion is configured to engage in the lock receiving opening in the plug connector.

The locking element on the plug connector is arranged so as to be movable in an attachment direction of the plug connector onto the multi-point connector so as to assume a locked position and at least one or more positions different from the locked position. An outer face of the plug portion comprises a lock actuation element that has a front face oriented in an insertion direction of the multi-point connector into the plug connector and a rear face facing away from the front face, so that, when the plug portion engages in the receiving portion, the lock actuation element is configured to engage behind the lock portion of the locking element. In the locked position, the rear face of the lock actuation element rests on the lock portion and at least one part of the lock portion overlaps the first side wall portion in an overlapping region, wherein the lock upper face rests against the inner face of the first side wall portion in the overlapping region.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
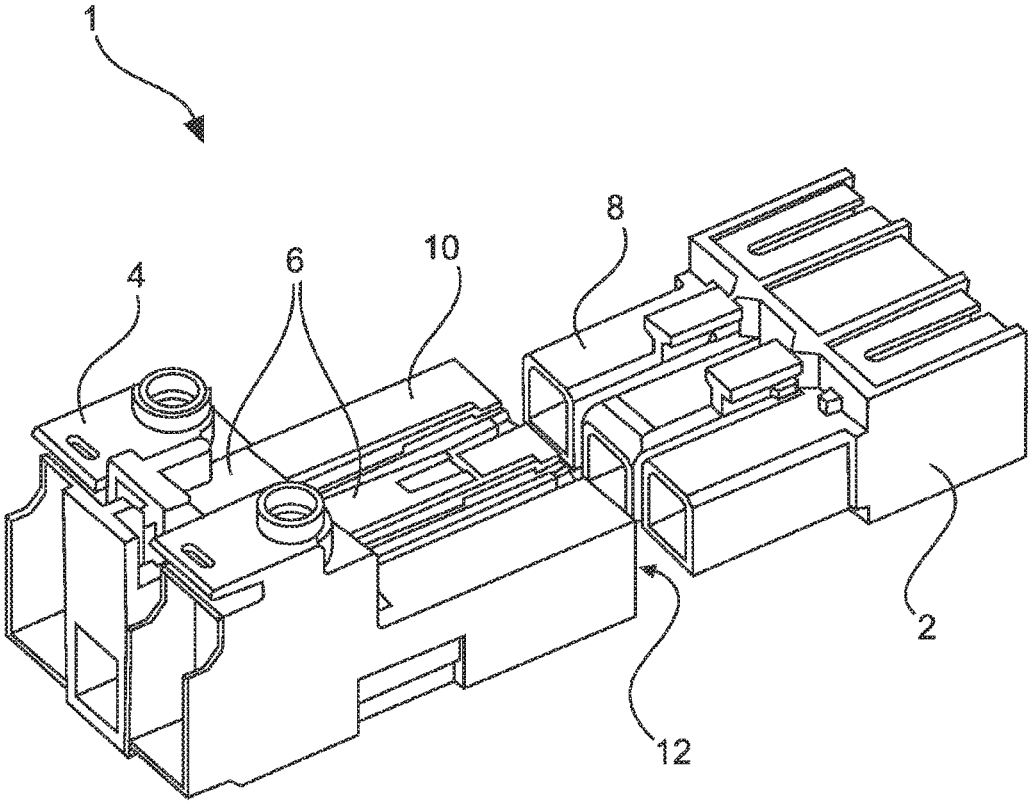
FIG. 1 is a three-dimensional view of a plug-in connector system according to a preferred embodiment of the invention.

According to the invention, a plug-in connector system is provided, comprising a multi-point connector, an electrical plug connector that can be attached to the multi-point connector, and a locking element for locking the electrical plug connector to the multi-point connector, the multi-point connector comprising a plug portion and the plug connector comprising a receiving portion that has a receiving opening such that, for connecting the plug connector to the multi-point connector, the plug portion can be guided through the receiving opening such that it engages in the receiving portion, a lock receiving opening being arranged in a side wall of the receiving portion at a spacing from the receiving opening, the side wall comprising a first side wall portion between the receiving opening and the lock receiving opening and a second side wall portion between the lock receiving opening and the receiving base, the locking element comprising a control element and a lock portion that has a lock upper face and a lock lower face, the lock portion engaging in the lock receiving opening in the plug connector, the locking element on the plug connector being arranged so as to be movable in the attachment direction of the plug connector onto the multi-point connector and in the process being able to assume a locked position and at least one position different from the locked position, an outer face of the plug portion comprising a lock actuation element that has a front face oriented in the insertion direction of the multi-point connector into the plug connector and a rear face facing away from the front face, such that, when inserting the plug portion into the receiving portion, the lock actuation element engages behind the lock portion of the locking element and, in the locked position, the rear face of the lock actuation element rests on the lock portion and at least one part of the lock portion overlaps the first side wall portion, the lock upper face resting against the inner face of the first side wall portion in the overlapping region.

It is thus a feature of the invention that, in the locked position, the rear face of the lock actuation element rests on the lock portion and at least one part of the lock portion overlaps the first side wall portion, the lock upper face resting against the inner face of the first side wall portion in the overlapping region. In this way, a separation force applied to the plug connector and/or the multi-point connector from the outside for separating the plug connection of the multi-point connector and plug connector, the separating force acting in a direction counter to the relevant insertion direction of the multi-point connector into the plug connector or the attachment direction of the plug connector onto the multi-point connector, is introduced into the first side wall portion by means of the lock actuation element and the lock portion. The lock portion is thus prevented from pivoting out of the lock receiving opening and the multi-point connector is impeded from unplugging from the plug connector.

A preferred embodiment of the invention provides that the position different from the locked position has a rest position and, in the rest position of the lock portion, has no overlaps and is arranged so as to be offset from the first side wall portion, the lock upper face facing the inner face of the first side wall portion. In this way, the lock portion rests inside the receiving portion in the rest position.

Another preferred embodiment of the invention provides that the position different from the locked position has an unlocked position that is also different from the rest position and, in the unlocked position, the lock lower face is arranged inside the receiving portion in alignment with the inner face of the first side wall portion. In this way, when the plug portion is introduced into the receiving portion, the lock actuation element is guided along the first side wall portion and past the lock receiving opening and the lock portion.

Furthermore, another preferred embodiment of the invention is that the movement direction of the locking element from the rest position into the locked position corresponds to the attachment direction of the plug connector onto the multi-point connector. In this way, a separating force acting on the plug connector and/or the multi-point connector from the outside for separating the plug connection can cause the locking element to move independently from the rest position into the locked position, as a result of which separation of the plug connection is prevented.

Correspondingly, another preferred embodiment of the invention provides that the movement direction of the locking element from the rest position into the unlocked position corresponds to the direction counter to the attachment direction of the plug connector onto the multi-point connector. This applies in particular also to the control element of the locking element. In this way, the movement direction of the control element for moving the locking element from the rest position into the unlocked position is in the same direction as the unplugging direction of the plug connector from the multi-point connector. The unlocking of the locking element and the unplugging process of the plug connector from the multi-point connector thus take place in the same direction, as a result of which the ease of use of the plug-in connector system is increased and the space required for unplugging the plug connector from the multi-point connector can be reduced.

Another preferred embodiment of the invention provides that a spring tongue is arranged between the control element and the lock portion. However, it is particularly preferably provided for the spring tongue to be pre-tensioned and to exert a pre-tensioning force on the multi-point connector in a direction perpendicular to the insertion direction of the plug connector. In this way, in the rest position, the position of the lock portion inside the receiving portion can be ensured.

In this context, another preferred embodiment of the invention provides that a pivot point is formed between the spring tongue and the control element and the spring tongue can pivot about said pivot point. In this way, the position of the lock portion in the lock receiving opening can be modified by a pivot movement of the spring tongue about the pivot point.

Another preferred embodiment of the invention is that a sliding portion is arranged between the spring tongue and the lock portion and a sliding edge is formed at the transition between the second side wall portion and the lock receiving opening, at least one part of the sliding portion resting on the sliding edge in the rest position and in the unlocked position. When the locking element moves from the rest position into the unlocked position, the sliding portion slides, starting from the connection region to the spring tongue, along the sliding edge up to the transition at the lock portion. As the sliding portion moves further along the sliding edge, the spring tongue is pivoted about the pivot point in a direction counter to the pre-tensioning force of the spring tongue. In this way, the position of the lock portion changes such that the lock actuation element can be guided past the lock lower face of the lock portion.

In addition, the formation of the sliding portion and the sliding edge and the pretension of the spring tongue mean that the locking element transitions independently into the rest position starting or from the unlocked position, in this way, the locking element can be moved directly into the locked position when a separating force is acting to separate the plug connection.

Another preferred embodiment provides that the lock front edge of the lock portion oriented in the direction of the receiving opening and/or the front face of the lock actuation element are chamfered. In this way, the insertion resistance for inserting the plug portion into the receiving portion can be reduced.

Another preferred embodiment of the invention provides that the rear face of the lock actuation element is chamfered. Preferably, the chamfer of the rear face corresponds to the incline of the sliding portion. In this way, the full surface of the rear face can rest against the lock portion and a separating force occurring for separating the plug connection can be introduced reliably into the lock portion.

Finally, another preferred embodiment of the invention provides that the lock actuation element is arranged on the front edge of the insertion portion of the plug portion. In this way, the length of the insertion portion can be limited.

FIG. 1 shows a plug-in connector system comprising a multi-point connector 2, an electrical plug connector 4 that can be attached to the multi-point connector 2, and a locking element 6 for locking the electrical plug connector 4 to the multi-point connector 2. The multi-point connector 2 comprises a plug portion 8 and the plug connector 4 comprises a receiving portion 10 that has a receiving opening 12 such that, for connecting the plug connector 4 to the multi-point connector 2, the plug portion 8 can be guided through the receiving opening 12 so as to engage in the receiving portion 10.

The locking element 6 is arranged on the plug connector 4 so as to be movable in the attachment direction of the plug connector 4 onto the multi-point connector 2 and can assume a rest position, a locked position and an unlocked position.

The movement direction of the locking element 6 from the rest position into the locked position corresponds to the attachment direction of the plug connector 4 onto the multi-point connector 2 and the movement direction of the locking element 6 from the rest position into the unlocked position corresponds to the direction counter to the attachment direction of the plug connector 4 onto the multi-point connector 2.

Figure 2:
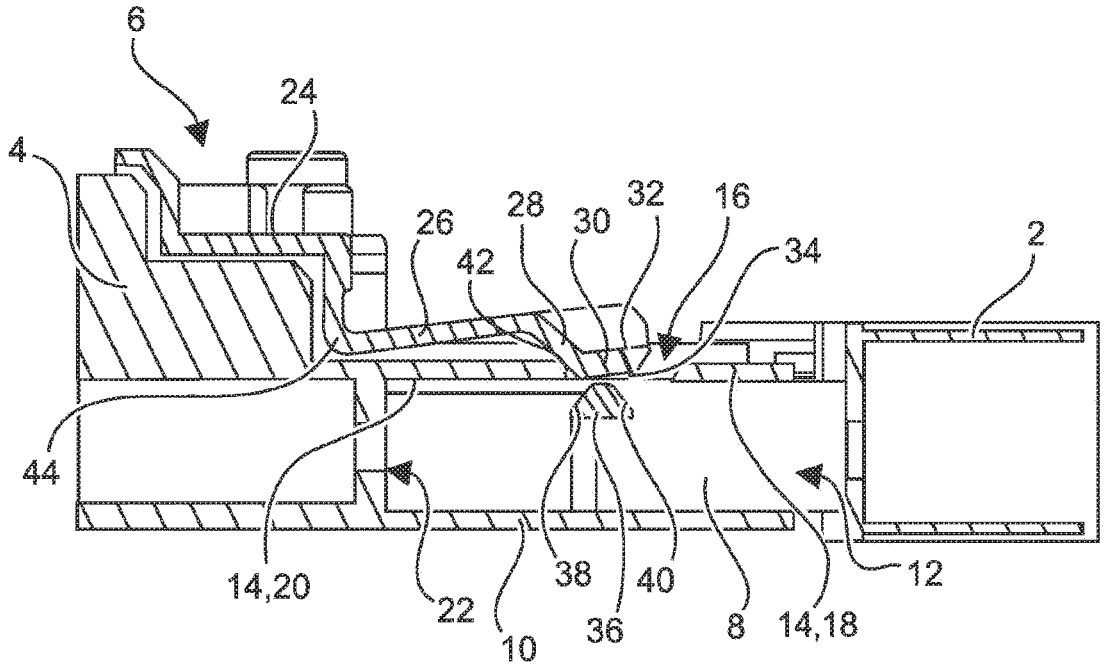
FIG. 2 is a sectional view of the plug-in connector system, the locking element being in the unlocked position, according to the preferred embodiment of the invention.

FIG. 2 shows a longitudinal section through the plug-in connector system, at least one part of the plug portion 8 being introduced into the receiving portion 10.

In a side wall 14 of the receiving portion 10, a lock receiving opening 16 is arranged at a spacing from the receiving opening 12, the insertion direction of the lock receiving opening 16 being arranged in a direction perpendicular to the insertion direction of the receiving opening 12. The lock receiving opening 16 divides the side wall 14 into a first side wall portion 18 between the receiving opening 12 and the lock receiving opening 16 and a second side wall portion 20 between the lock receiving opening 16 and the receiving base 22.

The locking element 6 comprises a control element 24, a pre-tensioned spring tongue 26 adjacent to the control element 24, a sliding portion 28 adjacent to the spring tongue 26, and a lock portion 30 adjacent to the sliding portion 28 and comprising a lock upper face 32 and a lock lower face 34, the lock portion 30 engaging in the lock receiving opening 16 of the plug connector 4 by the lock lower face 34 in the present case.

It can also be seen that a sliding edge 42 is formed at the transition between the second side wall portion 20 and the lock receiving opening 16, and at least one part of the sliding portion 28 rests on the sliding edge 42.

A lock actuation element 36 comprising a front face 38 oriented in the insertion direction of the multi-point connector 2 into the plug connector 4 and a rear face 40 facing away from the front face 38 is arranged on an outer face of the plug portion 8.

In the present case, the locking element 6 is shown in the unlocked position. In the unlocked position, the spring tongue 26 is pivoted about the pivot point 44 formed between the control element 24 and the spring tongue 26, and the sliding portion 28 rests on the sliding edge 42 in the transition to the lock portion 30. In this way, the lock portion 30 is raised in the lock receiving opening 16 such that at least one part of the lock lower face 34 is arranged in alignment with the inner face of the first side wall portion 18.

Therefore, when the plug portion 8 is introduced into the receiving portion 10, the lock actuation element 36 can be guided along the first side wall portion 18 and past the lock receiving opening 16 and the lock portion 30.

Figure 3:
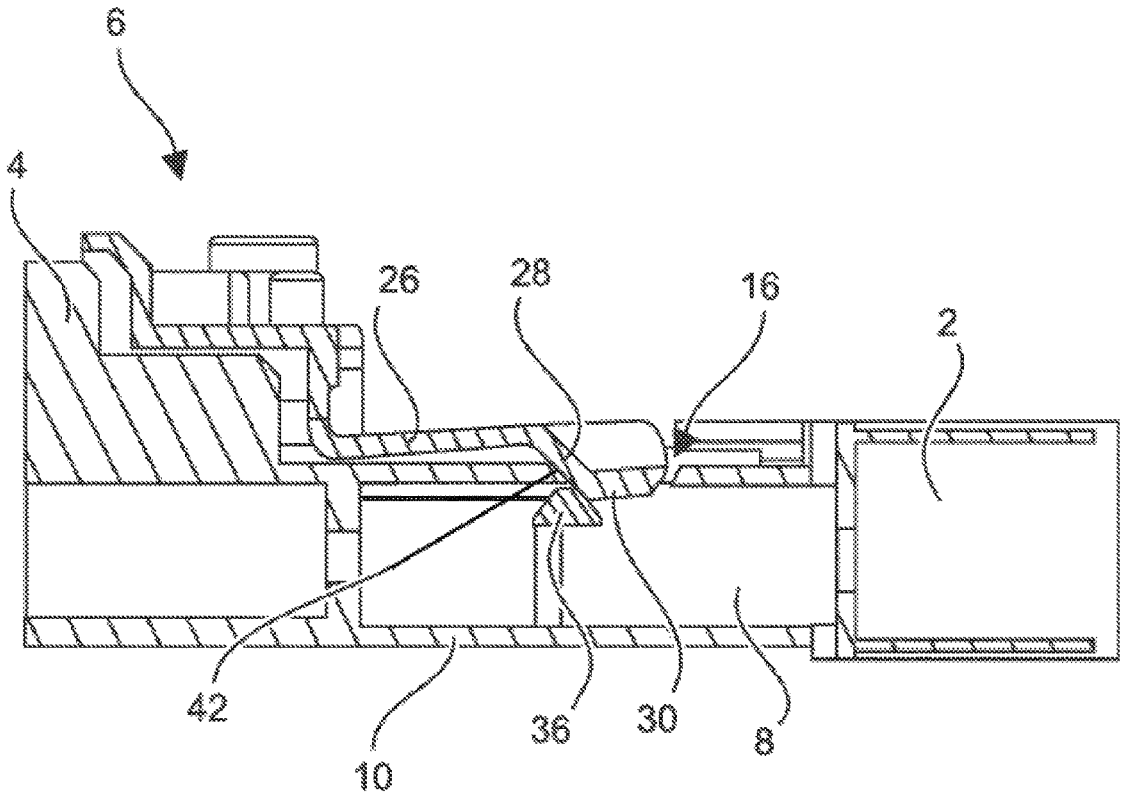
FIG. 3 is a sectional view comprising a locking element, the locking element being in a transition position between the unlocked position and the rest position, according to the preferred embodiment of the invention.

FIG. 3 shows that the plug portion 8 is introduced far into the receiving portion 10 such that the lock actuation element 36 engages behind the lock portion 30. The pretension of the spring tongue 26, which exerts a pre-tensioning force on the multi-point connector 2 in a direction perpendicular to the insertion direction of the plug connector 4, causes the sliding portion 28 to move along the sliding edge 42 and thus causes the lock portion 30 to enter the receiving portion 10 through the lock receiving opening 16. In this way, the locking element 6 transitions independently from the unlocked position into the rest position.

Figure 4:
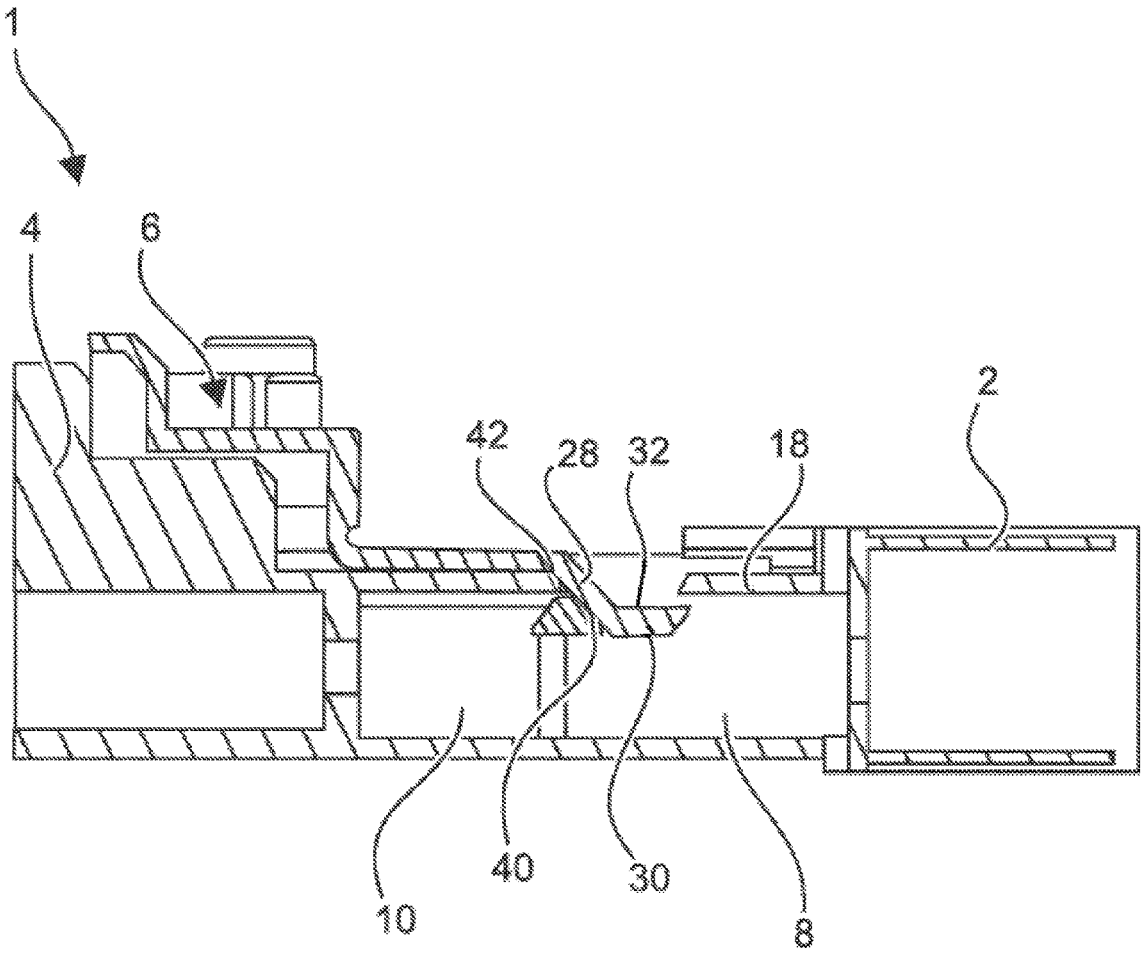
FIG. 4 is a sectional view comprising a locking element, the locking element being in the rest position, according to the preferred embodiment of the invention.

FIG. 4 shows the plug-in connector system comprising the plug connector 4 attached to the multi-point connector 2, the locking element 6 being in the rest position. In the rest position, the lock portion 30 is arranged inside the receiving portion 10 with no overlaps and so as to be offset from the first side wall portion 18, the lock upper face 32 facing the inner face of the first side wall portion 18. In addition, it can be seen that the rear face 40 of the lock actuation element 36 is chamfered and is in alignment with the sliding edge 42.

Figure 5:
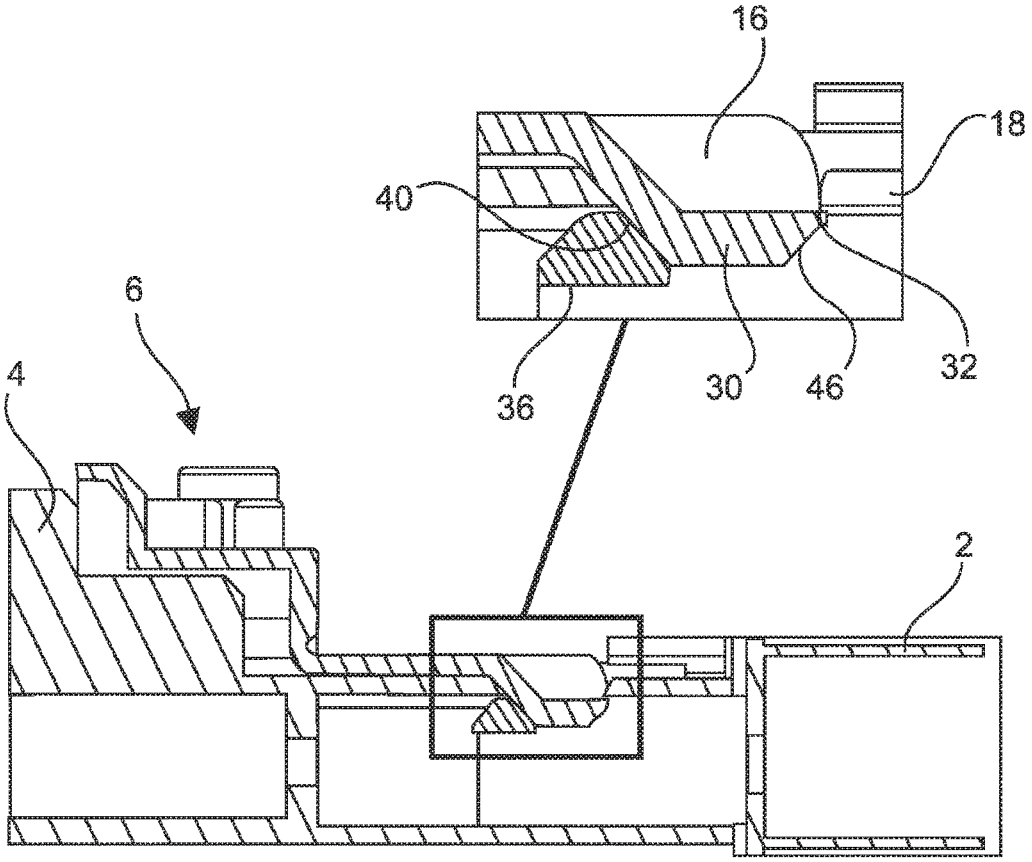
FIG. 5 is a sectional view of the plug-in connector system comprising a locking element, the locking element being in the locked position, according to the preferred embodiment of the invention.

FIG. 5 shows the plug-in connector system 1 having the plug connector 4 attached to the multi-point connector 2, the locking element 6 being in the locked position.

In the locked position, the rear face 40 of the lock actuation element 36 rests on the lock portion 30. A part of the lock portion 30 overlaps the first side wall portion 18, the lock upper face 32 resting against the inner face of the first side wall portion 18 in the overlapping region.

In this way, a separation force applied to the plug connector 4 and/or the multi-point connector 2 from the outside for separating the plug connection 1, the separating three acting in a direction counter to the relevant insertion direction of the multi-point connector 2 into plug connector 4 or to the attachment direction of the plug connector 4 onto the multi-point connector 2, is introduced into the first side wall portion 18 by means of the lock actuation element 36 and the lock portion 30. The lock portion 30 is thus prevented from pivoting out of the lock receiving opening 16, as a result of which the plug connection 1 is locked.

The locking element 6 transitions from the rest position into the locked position by means of a separating force applied from the outside. This causes the lock actuation element 36 to move in the attachment direction of the plug connector 4 onto the multi-point connector 2.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 plug-in connector system
2 multi-point connector
4 plug connector
6 locking element
8 plug portion
10 receiving portion
12 receiving opening
14 side wall
16 lock receiving opening
18 first side wall portion
20 second side wall portion
22 receiving base
24 control element
26 spring tongue
28 sliding portion
30 lock portion
32 lock upper face
34 lock lower face
36 lock actuation element
38 front face
40 rear face
42 sliding edge
44 pivot point
46 lock front edge

The invention claimed is:

1. A plug-in connector system comprising:

a multi-point connector;

an electrical plug connector configured to be attached to the multi-point connector; and a locking element configured to lock the electrical plug connector to the multi-point connector, wherein the multi-point connector comprises a plug portion and the plug connector comprises a receiving portion that has a receiving opening such that, for connecting the plug connector to the multi-point connector, the plug portion is configured to be guided through the receiving opening so as to engage in the receiving portion, wherein a lock receiving opening is arranged in a side wall of the receiving portion at a spacing from the receiving opening, wherein the side wall comprises a first side wall portion between the receiving opening and the lock receiving opening and a second side wall portion between the lock receiving opening and a receiving base of the receiving portion, wherein the locking element comprises a control element and a lock portion that has a lock upper face and a lock lower face, wherein the lock portion is configured to engage in the lock receiving opening in the plug connector, wherein the locking element on the plug connector is arranged so as to be movable in an attachment direction of the plug connector onto the multi-point connector so as to assume a locked position and at least one position different from the locked position, wherein an outer face of the plug portion comprises a lock actuation element that has a front face oriented in an insertion direction of the multi-point connector into the plug connector and a rear face facing away from the front face, so that, when the plug portion engages in the receiving portion, the lock actuation element is configured to engage behind the lock portion of the locking element and, wherein, in the locked position, the rear face of the lock actuation element rests on the lock portion and at least one part of the lock portion overlaps the first side wall portion in an overlapping region, wherein the lock upper face rests against an inner face of the first side wall portion in the overlapping region.

2. The plug-in connector system according to claim 1, wherein the at least one position different from the locked position comprises a rest position and, in the rest position of the lock portion, the lock portion is arranged inside the receiving portion so as to be offset from the first side wall portion, the lock upper face facing the inner face of the first side wall portion.

3. The plug-in connector system according to claim 2, wherein the at least one position different from the locked position further comprises an unlocked position different from the rest position and, in the unlocked position, the lock lower face is arranged in alignment with the inner face of the first side wall portion.

4. The plug-in connector system according to claim 2, wherein a movement direction of the locking element from the rest position into the locked position corresponds to the attachment direction of the plug connector onto the multi-point connector.

5. The plug-in connector system according to claim 3, wherein a movement direction of the locking element from the rest position into the unlocked position corresponds to a direction counter to the attachment direction of the plug connector onto the multi-point connector.

6. The plug-in connector system according to claim 1, further comprising a spring tongue arranged between the control element and the lock portion.

7. The plug-in connector system according to claim 6, wherein the spring tongue is pre-tensioned and is configured to exert a pre-tensioning force in a direction perpendicular to the attachment direction of the plug connector onto the multi-point connector.

8. The plug-in connector system according to claim 6, wherein the at least one position different from the locked position comprises a rest position and an unlocked position, and wherein a sliding portion is arranged between the spring tongue and the lock portion and a sliding edge is formed at a transition between the second side wall portion and the lock receiving opening, at least one part of the sliding portion resting on the sliding edge in the rest position and in the unlocked position.

9. A plug-in connector system comprising:

a multi-point connector;

an electrical plug connector configured to be attached to the multi-point connector; and a locking element configured to loci the electrical plug connector to the multi-point connector, wherein the multi-point connector comprises a plug portion and the plug connector comprises a receiving portion that has a receiving opening such that, for connecting the plug connector to the multi-point connector, the plug portion is configured to be guided through the receiving opening so as to engage in the receiving portion, wherein a lock receiving opening is arranged in a sidewall of the receiving portion at a spacing from the receiving opening, wherein the side wall comprises a first side wall portion between the receiving opening and the lock receiving opening and a second side wall portion between the lock receiving opening and a receiving base of the receiving portion, wherein the locking element comprises a control element and a lock portion that has a lock upper face and a lock lower face, wherein the lock portion is configured to engage in the lock receiving opening in the plug connector, wherein the locking, element on the plug connector is arranged so as to be movable in an attachment direction of the plug connector onto the multi-point connector so as to assume a locked position and at least one position different from the locked position, and wherein an outer face of the plug portion comprises a lock actuation element that has a front face oriented in an insertion direction of the multi point connector into the plug connector and a rear face facing away from the front face, so that, when the plug portion engages in the receiving portion, the lock actuation element is configured to engage behind the lock portion of the locking element, and wherein, in the locked position, the rear face of the lock actuation element rests on the lock portion and at least one part of the lock portion overlaps the first side wall portion in an overlapping region, wherein the lock upper face rests against an inner face of the first side wall portion in the overlapping region, the plug-in connector system further comprising a spring tongue arranged between the control element and the lock portion, and a pivot point formed between the spring tongue and the control element, the spring tongue being configured to pivot about said pivot point.

10. A plug-in connector system comprising:

a multi-point connector;

an electrical plug connector configured to be attached to the multi-point connector; and a locking element configured to lock the electrical plug connector to the multi-point connector, wherein the multi-point connector comprises a plug portion and the plug connector comprises a receiving portion that has a receiving opening such that, for connecting the plug connector to the multi-point connector, the plug portion is configured to be guided through the receiving opening so as to engage in the receiving portion, wherein a lock receiving opening is arranged in a side wall of the receiving portion at spacing from the receiving opening, wherein the side wall comprises a first side wall portion between the receiving opening and the lock receiving opening and a second side wall portion between the lock receiving opening and a receiving base of the receiving portion, wherein the locking element comprises a control element and a lock portion that has a lock upper face and a lock lower face, wherein the lock portion is configured to engage in the lock receiving opening in the plug connector, wherein the locking element on the plug connector is arranged so as to be movable an attachment direction of the plug connector onto the multi-point connector so as to assume a locked position and at least one position different from the locked position, and wherein an outer face of the plug portion comprises a lock actuation element that has a front face oriented in an insertion direction of the multi-point connector into the plug connector and a rear face facing away from the front face, so that, when the plug portion engages in the receiving portion, the lock actuation element is configured to engage behind the lock portion of the locking element, wherein, in the locked position, the rear face of the lock actuation element rests on the lock portion and at least one part of the lock portion overlaps the first side wall portion in an overlapping region, wherein the lock upper face rests against an inner face of the first side wall portion in the overlapping region, and wherein a lock front edge of the lock portion is oriented in a direction of the receiving opening, and/or the front face of the lock actuation element is chamfered.

* * * * *